US006543912B1

(12) United States Patent
Simon

(10) Patent No.: US 6,543,912 B1
(45) Date of Patent: Apr. 8, 2003

(54) CONSTRUCTION FOR DECORATIVE PATTERNING, DISTRIBUTION OF ILLUMINATION, AND FLEXIBLE PROJECTION OF LINEAR LIGHT SOURCES

(76) Inventor: Jerome H. Simon, 70 Sumner St., Newton Centre, MA (US) 02159

( * ) Notice: Subject to any disclaimer, the term of this patent is extended or adjusted under 35 U.S.C. 154(b) by 0 days.

(21) Appl. No.: 09/451,069

(22) Filed: Nov. 30, 1999

Related U.S. Application Data

(60) Provisional application No. 60/111,125, filed on Dec. 4, 1998.

(51) Int. Cl.[7] ..... F21V 5/00

(52) U.S. Cl. ..... 362/327; 362/331; 362/338

(58) Field of Search ..... 362/308, 327, 362/329, 331, 332, 333, 334, 335, 336, 337, 339, 340, 268

(56) References Cited

U.S. PATENT DOCUMENTS

| | | | | | |
|---|---|---|---|---|---|
| 2,741,694 | A | * | 4/1956 | Thomstab et al. | 362/327 |
| 3,544,785 | A | * | 12/1970 | Weibel | 362/331 |
| 4,499,406 | A | * | 2/1985 | Saburo | 362/327 |
| 4,991,070 | A | * | 2/1991 | Stob | 362/329 |

* cited by examiner

*Primary Examiner*—Y. My Quach-Lee
(74) *Attorney, Agent, or Firm*—Jerry Cohen; Harvey Kaye; Perkins, Smith & Cohen

(57) ABSTRACT

A light assembly includes a linear light source has a longitudinal axis and a refractor and/or a reflector. A main refractor extends along the length of the light source and parallel thereto. The main refractor has a rear portion coated with a reflecting material in a desired pattern extending along the length of the main refractor.

19 Claims, 9 Drawing Sheets

10
84
86
88
90
92
94
96
98
100
102
104
106
108
110
112
114 + 116
119
83

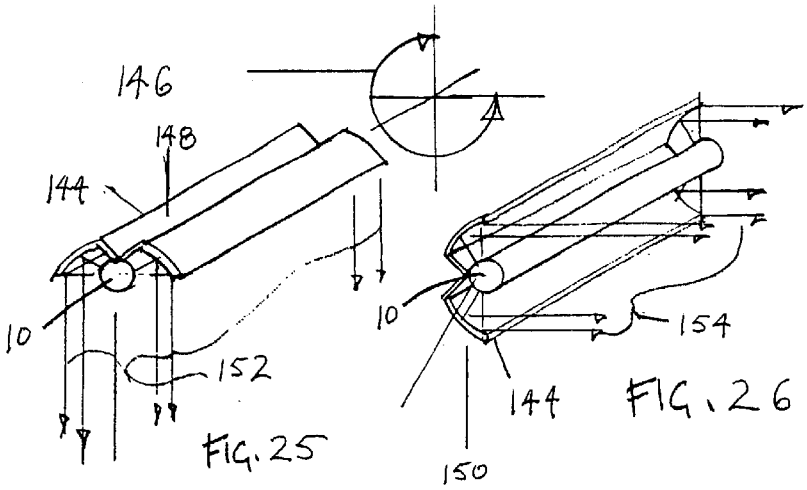
FIG. 25
FIG. 26
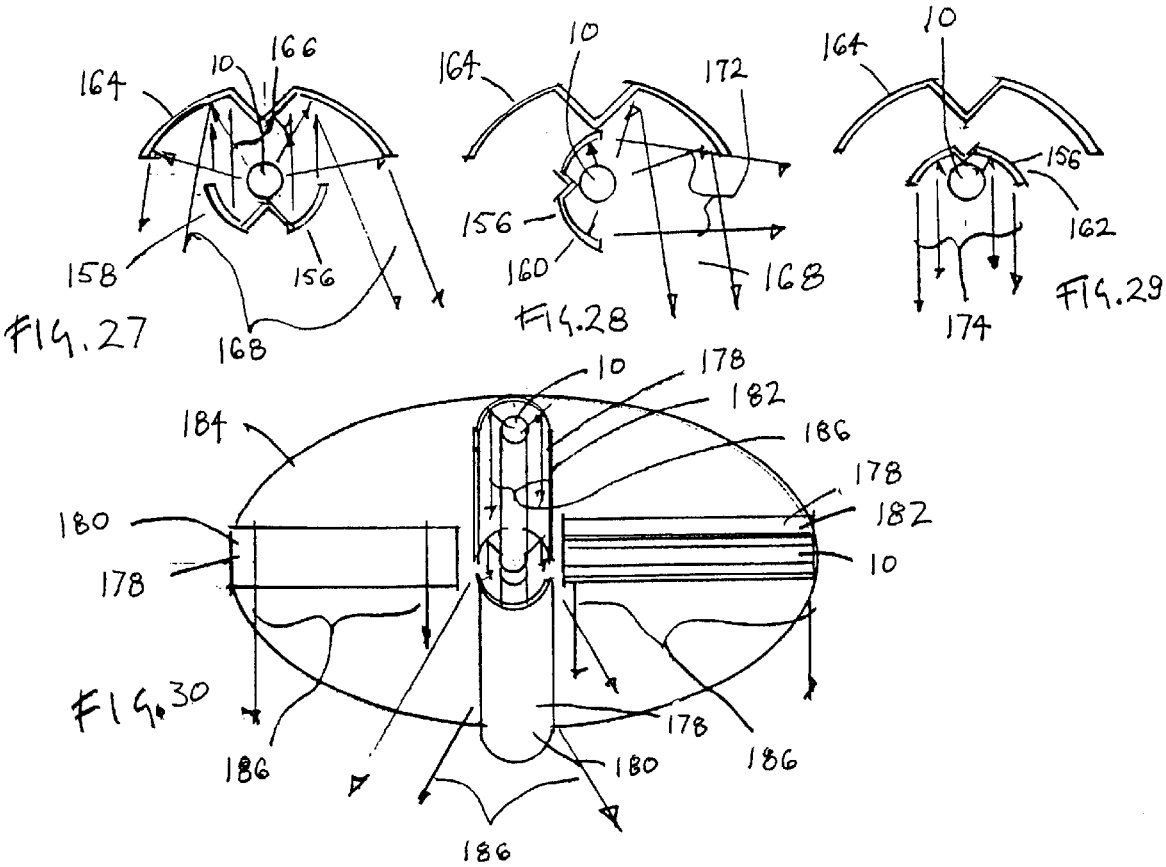
FIG. 27
FIG. 28
FIG. 29
FIG. 30

CONSTRUCTION FOR DECORATIVE PATTERNING, DISTRIBUTION OF ILLUMINATION, AND FLEXIBLE PROJECTION OF LINEAR LIGHT SOURCES

CROSS-REFERENCE TO RELATED APPLICATIONS

This application is based upon and claims the priority of Provisional Application Ser. No. 60/111,125 filed Dec. 4, 1998.

FIELD OF THE INVENTION

The present invention relates generally to the lighting field, and, more particularly, to creating efficient and decorative distribution of illumination and flexible projection of linear light sources.

BACKGROUND OF THE INVENTION

U.S. Pat. No. 2,356,654 discloses a linear light source system which has refraction and reflection in one arrangement.

U.S. Pat. No. 4,459,643 discloses an arrangement using a tubular light source in which a lens system focuses the light onto a photo-conductive cable.

U.S. Pat. No. 4,779,178 discloses a linear light source having a reflector formed of strip-like mirror surfaces.

U.S. Pat. No. 4,876,633 discloses a linear light source having a housing bounded by two curved surfaces.

U.S. Pat. No. 5,658,066 discloses a linear lighting arrangement in which a continuous row of sectional lighting assemblies are used.

In my U.S. Pat. No. 5,971,570, issued Oct. 26, 1999, entitled Decorative Prismatic Lens Jacket For A Lineal Source, there is disclosed a jacket for a lineal light source which provides virtual images of the source altered in shape or dispersion and direction.

In my co-pending application Ser. No. 08/803,797 filed Feb. 24, 1997, there is disclosed a tubular light source with a generally refractive-reflective lighting jacket surrounding it in which the jacket has flutes.

SUMMARY OF THE INVENTION

It is an object of the present invention to provide broad distribution and highly direct indoor and outdoor illumination.

It is another object of the present invention to provide lighting of the type described which is efficient and decorative.

It is a further object of the present invention to provide lighting which directly projects and distributes light broadly onto adjacent surfaces.

It is yet another object of the present invention to provide lighting using shaped light projection.

It is yet a further object of the present invention to provide such lighting using non-conventional means.

It is still another object of the present invention to provide a decorative means of distributing light from linear sources such as fluorescent without diminishing efficiency.

It is still a further object of the present invention to provide a system for varying the direction and spread of light from linear light sources.

At least in part the benefits of the present invention are provided by greater efficiency by using no reflectors, or fewer reflectors than the prior art.

These and other objects of the present invention are accomplished in the following manners, among others.

A light assembly including a linear light source has a longitudinal axis and a refractor and/or a reflector. A main refractor extends along the length of the light source and parallel thereto. The main refractor has a rear portion coated with a reflecting material in a desired pattern extending along the length of the main refractor.

There may be a unified reflector partially surrounding the front of the light source and extending along the length of the light source. The reflector has openings therein at selected locations, one set of such openings providing light directly from the light source to the front of the assembly. The reflector has reflecting surfaces extending from the sides thereof and another set of such openings being located between the light source and the reflecting surfaces such that light from the light source is reflected from the reflecting surfaces toward the front of the assembly.

There may be a reflector assembly surrounding the length of the light source and including a plurality of reflector segments at least some of which are movable about the light source longitudinal axis. There is one group of reflector segments which are spaced apart from each other on a side of the light source and being connected together for movement together about the longitudinal axis. There is another group of reflector segments which are spaced apart from each other on a side of the light source being connected together for movement together about the longitudinal axis whereby the reflector segments are interdigitated. The groups of reflector segments are movable continuously into different angular positions about the axis whereby the groups may be moved to one position where they are on opposite sides of the light source, another position where they are all aligned on the same side of the light source, and any position therebetween.

There may be a plurality of reflecting transmission guides partially surrounding the linear light source and arranged radially with respect thereto and each having an entry face at least partially surrounding the light source, and each having a reflective surface, and each having an exit surface for the light to leave, whereby rays from the light source enter the entry surface pass though its transparent composition to its reflecting surface and are reflected through exit surface as rays. There is a linear refractive element partially surrounding the light source that acts as a connector for supporting the guides and for refracting light which is not collected by the guides for redirecting such rays.

There may be a reflector adjacent the light source and extending parallel thereto along the length thereof and the reflector is rotatable about the axis through 360 degrees.

There may be four linear light sources and four first reflectors, each partially surrounding a respective light source and extending for the length thereof and each rotatable for 360 degrees about its light source. There is a second reflector on one side of the four light sources and sufficiently large as to be capable of receiving rays reflected from the first reflectors when the first reflectors are in an angular position to reflect light toward the one side.

The means by which the foregoing objects and features of invention are achieved is pointed out in the claims forming the concluding portion of the specification. The invention, both as to its organization and manner of operation, may be further understood by reference to the following description taken in connection with the following drawings.

BRIEF DESCRIPTION OF THE DRAWINGS

FIG. 25 is an isometric view of a rotatable reflector shown in its upper position.

FIG. 26 is an isometric view of the rotatable reflector shown in FIG. 25, but in a side position.

FIG. 27 is a diagrammatic sectional view showing two reflectors, one being rotatable and in its lower position.

FIG. 28 is a diagrammatic sectional view showing the reflectors of FIG. 27 with the rotatable reflector being in its side position.

FIG. 29 is a diagrammatic sectional view showing the reflectors of FIG. 27 with the rotatable reflector being in its upper position.

FIG. 30 is a schematic view of a lighting arrangement wherein there are four light sources.

DETAILED DESCRIPTION OF THE PREFERRED EMBODIMENTS

Figure 1:
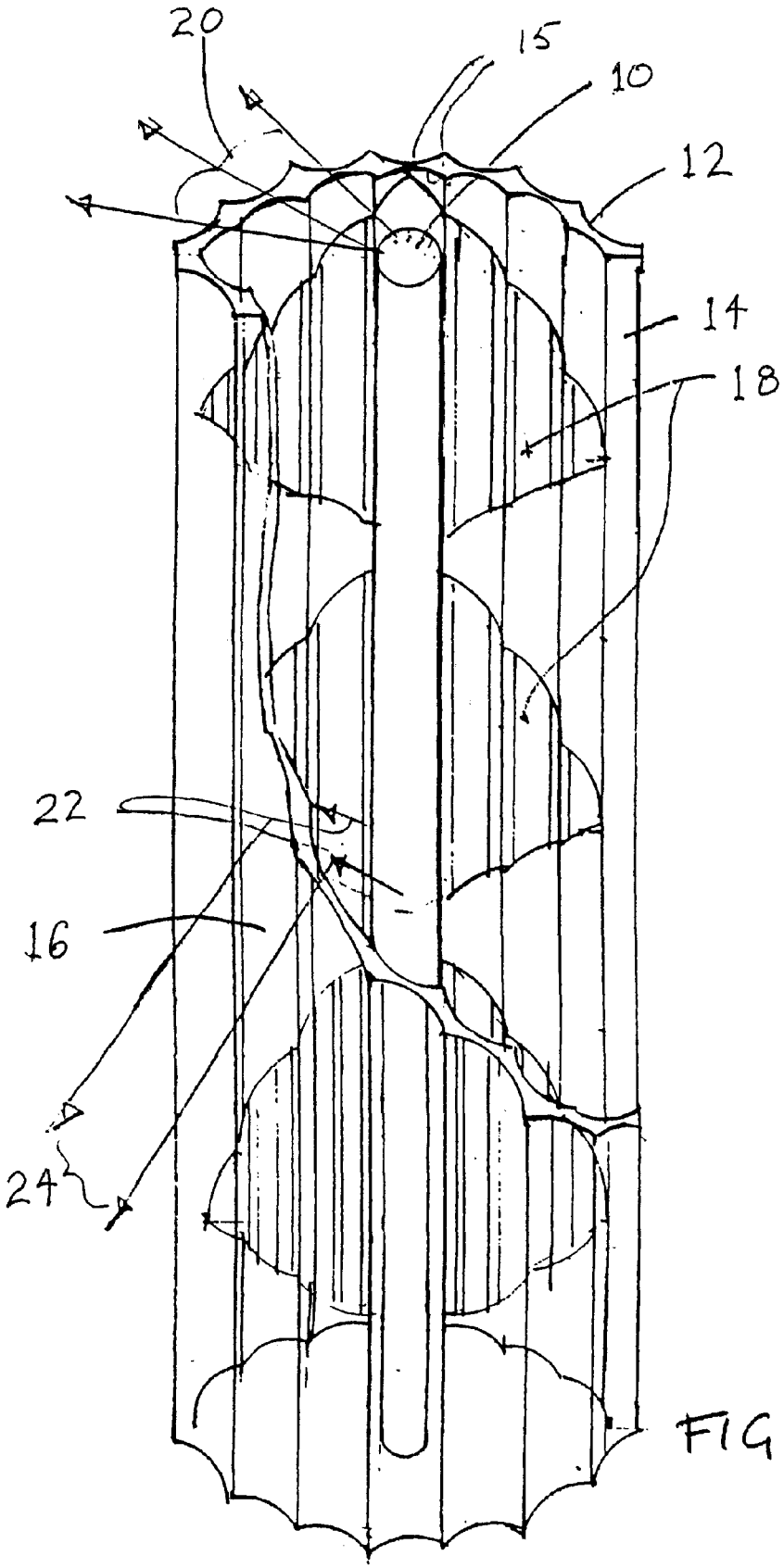
FIG. 1 is a partial isometric view of a lighting arrangement with part cutaway of a linear light arrangement of the present invention.

FIG. 1 is a diagrammatic cutaway section view of a linear lighting product containing a linear light source (such as a fluorescent tube) 10 surrounded by a refractive jacket 12. Refractive jacket 12 is composed of a rear refracting element 14 and a front refracting element 16. The rear refracting element 14 has a pattern of specular surfacing 18 that may be vacuum deposited on either the inside or the outside surface of 14. The specular surface 18 may be of other reflective materials such as specular aluminum or aluminized polyester. Rays 20 emanating from light source 10 pass through rear refractive element 14, while rays 22 emanating from light source 10 are reflected by specular surface 18 toward and through front refracting element 16 as rays 24. The resulting visual effect of the combined elements is a pattern of bright shapes at specular surface 18 and dim shapes at non-reflective areas of rear refracting element 14.

The rear refracting element 14 may be fluted at its front and rear surfaces as shown at 15 which is shown as concave to provide negative refraction with the surface facing light source 10 being parallel to the light source. The fluting could also be convex to provide positive refraction.

Figure 2:
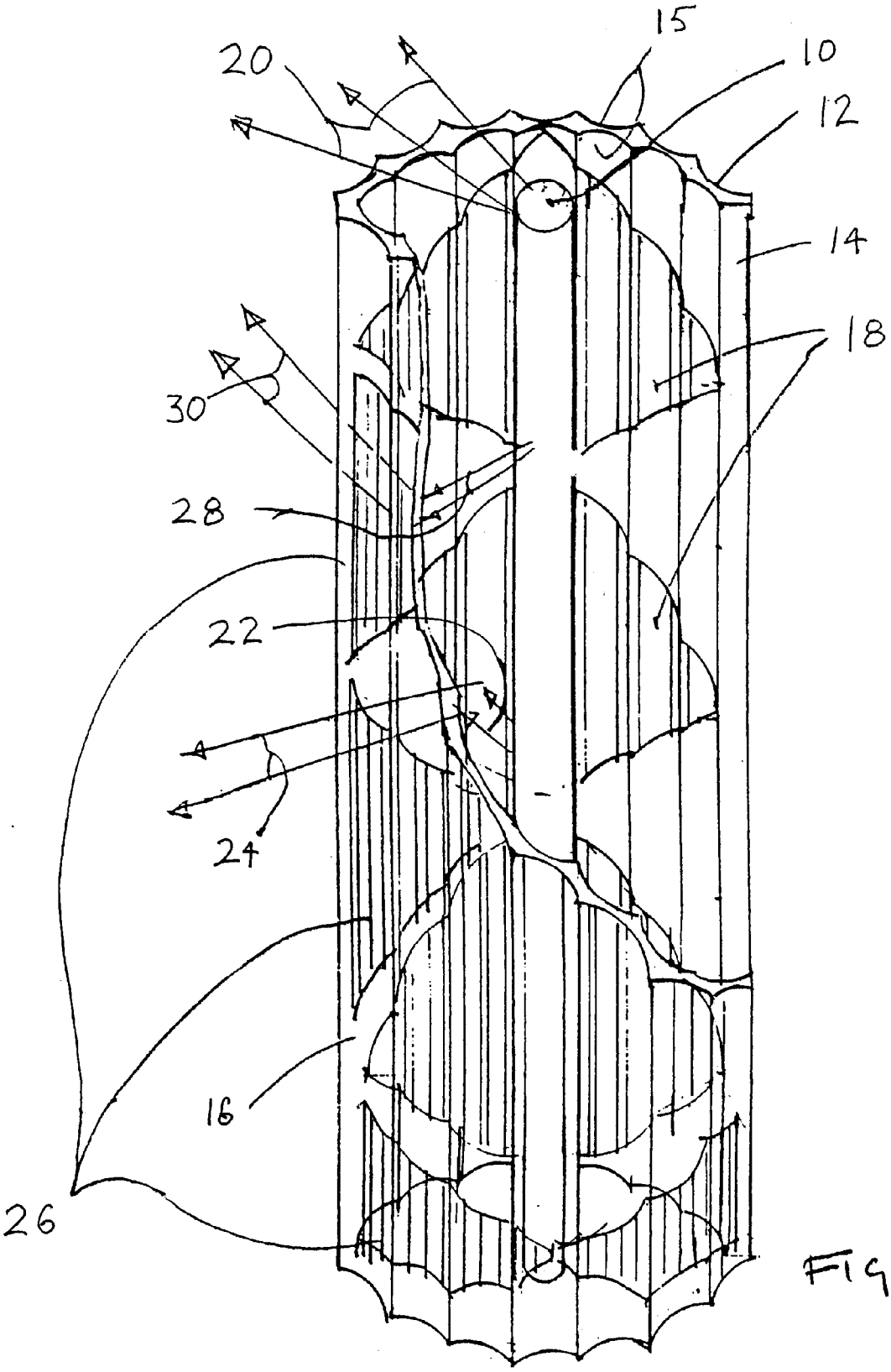
FIG. 2 is a partial isometric view of a lighting arrangement similar to FIG. 1 and having a specular patterned reflector on part of the front refracting element of the refractive jacket.

FIG. 2 is identical in structure and function to FIG. 1, with the exception of the addition of a specular pattern 26 applied to the front refracting surface 16. Rays 28 emanating from light source 10 are reflected off the specular material on the front refracting surface 16 through rear refractive element 14 as rays 30 between areas of the specular surface 18.

Figure 3:
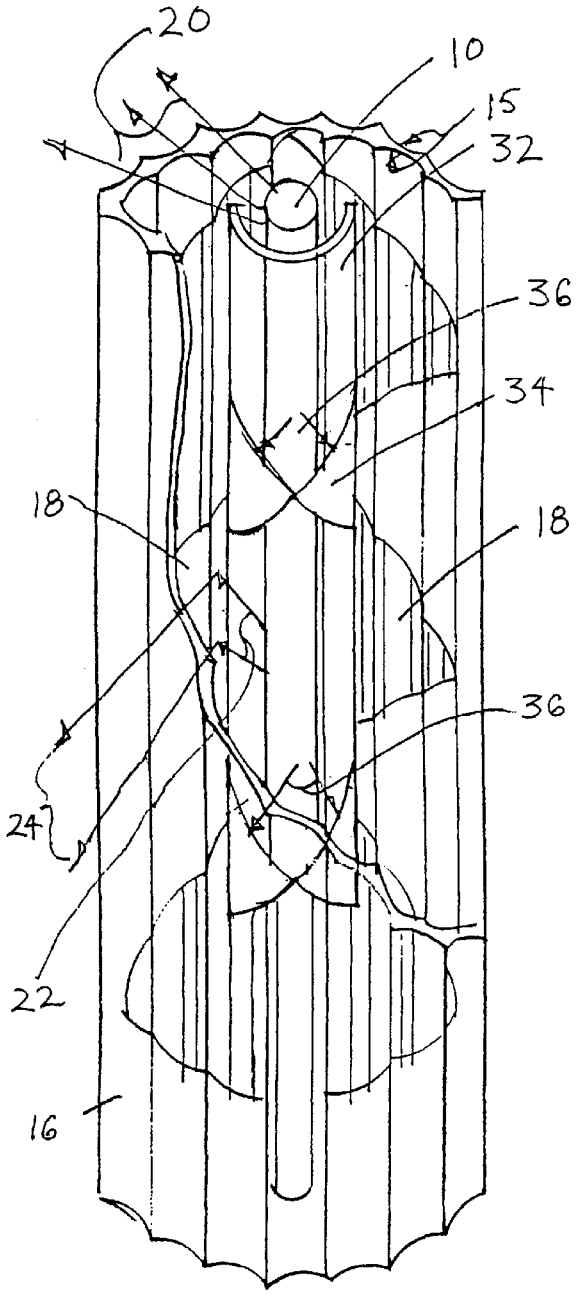
FIG. 3 is a partial isometric view of a lighting arrangement similar to FIG. 1, and having a central refracting element.

FIG. 3 is identical in structure and function to FIG. 1. FIG. 3, with the exception of the addition of central refracting element 32 that partially surrounds light source 10. In this configuration, central refracting element 32 is a 180 degree clear tube section having a pattern of reflective elements 34 vacuum deposited upon its surface. Light rays 20 emanating from light source 10 are reflected by reflective elements 34 back toward the light source 10. The combined results of rays 20 passing through rear refracting element 14, rays 24 having been reflecting off specular surface 18 and passing through front refracting element 16 and rays 36 being reflected back create a pattern of contrasting areas of relative brightness (when the structure is viewed as in FIG. 4). Relative areas of brightness are illustrated with dark areas D, moderately bright areas M, and bright areas B.

Figure 5:
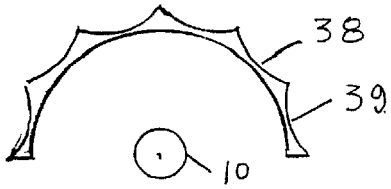
FIG. 5 is a schematic sectional view showing one type rear refractor.
Figure 8:
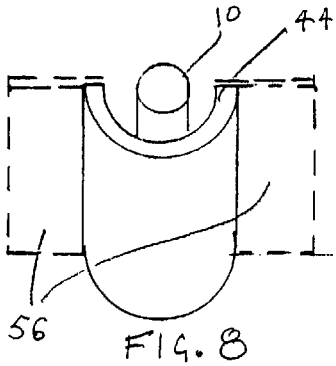
FIG. 8 is a schematic sectional view showing one type of central refractor.
Figure 6:
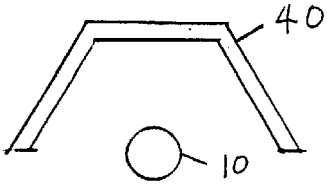
FIG. 6 is a schematic sectional view showing another type of rear refractor.
Figure 9:
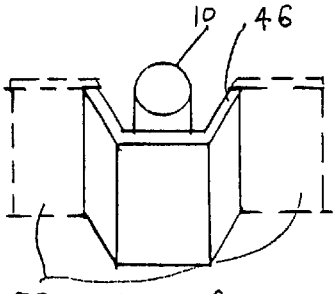
FIG. 9 is a schematic sectional view showing another type of central refractor.
Figure 7:
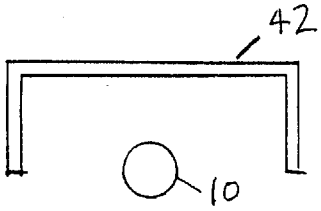
FIG. 7 is a schematic sectional view showing a further type of rear refractor.
Figure 10:
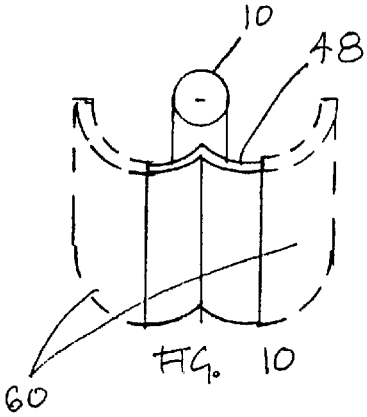
FIG. 10 is a schematic sectional view showing a further type of central refractor.

FIGS. 5, 6 and 7 illustrate cross-sectional variations of rear refractors as shown as 38, 40 and 42, respectively, in FIG. 1. FIGS. 8, 9 and 10 illustrate cross-sectional variations of the central refracting element 32 as shown as 32 in FIG. 3.

Figure 11:
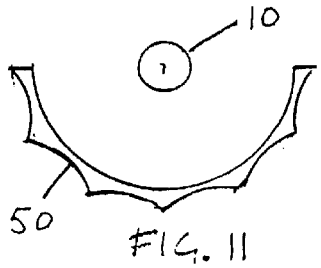
FIG. 11 is a schematic sectional view showing one type of front refractor.
Figure 12:
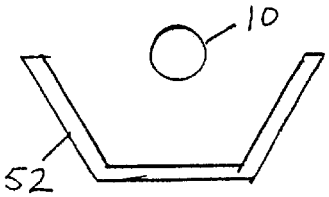
FIG. 12 is a schematic sectional view showing another type of front refractor.
Figure 13:
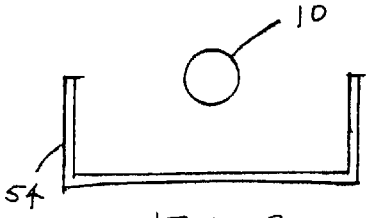
FIG. 13 is a schematic sectional view showing a further type of refractor.

FIGS. 11, 12 and 13 illustrate cross-sectional variations of the front refracting element 16 as shown as 16 in FIG. 1.

FIG. 5 shows a linear light source 10 with a rear linear refracting element 38. Rear linear refracting element 38 is shown as a 180 degree section of a circle for graphic purposes, yet represents any arc of a circle or other curvilinear shape such as an ellipse, parabola, hyperbola or oval. The refracting element 38 is shown as concave cylindrical in shape at 39 to provide negative refraction, but it could be made convex to provide positive refraction.

FIG. 6 shows a linear light source 10 with a rear-refracting element 40. Rear refracting element 40 is shown as one half a hexagon representing any section of a regular or irregular polyhedron.

FIG. 7 shows a linear light source 10 with a rear-refracting element 42 in the form of a rectangle.

FIG. 8 shows a linear light source 10 with a central refracting element 44. Although central refracting element 44 is shown as a 180 degree section of a circular tube, represents any curvilinear shape such as an ellipse, parabola, hyperbola, or oval.

FIG. 9 shows a central refracting element 46. Although central refracting element 46 is shown as one half a hexagon, it represents any other portion of a regular or irregular polyhedron.

FIG. 10 shows a light source 10 with a central refracting element 48. Central refracting element 48 is constructed of two curved linear sections. The curvature of these sections may be circular, parabolic, elliptical, or hyperbolic.

FIGS. 11, 12 and 13 show front refracting elements 50, 52 and 54 respectively of linear light source 10. The descriptions of front refracting elements 50, 52 and 54 match those of rear refracting elements 38, 40 and 42, respectively.

FIGS. 5–13 may be considered to represent clear refracting elements with or without patterns of reflecting surfaces on either side of the material. Any of the rear refracting elements of FIGS. 5, 6 and 7 can be combined with any of the front refracting elements of FIGS. 11, 12 and 13. Any combined elements of FIGS. 5, 6 and 7 and FIGS. 11, 12 and 13 can be combined with any of the central refracting elements of FIGS. 8, 9 and 10. The arrangement of these elements is graphically illustrated in FIG. 3.

There are connecting elements 56, 58 and 60 of FIGS. 8, 9 and 10, respectively, that may be used to connect the central refracting elements 44, 46 and 48 to the rear refracting elements 38, 40 and 42, respectively, or the front refracting elements 50, 52 and 54, respectively.

The inner and outer surfaces of the refracting elements (of FIGS. 5–13) can have negative flutes, positive flutes (cylindrical lensing) or V grooves as required, to modify light patterns by altering the direction of rays entering or leaving the refracting elements.

Figure 14:
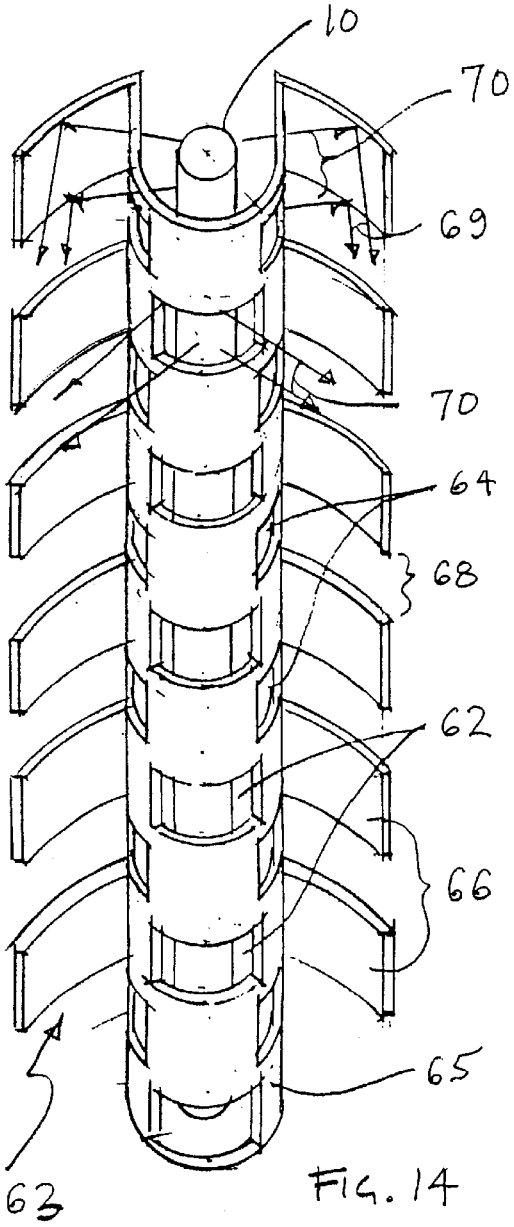
FIG. 14 is an isometric view of a lighting arrangement having a unified reflector structure.
Figure 15:
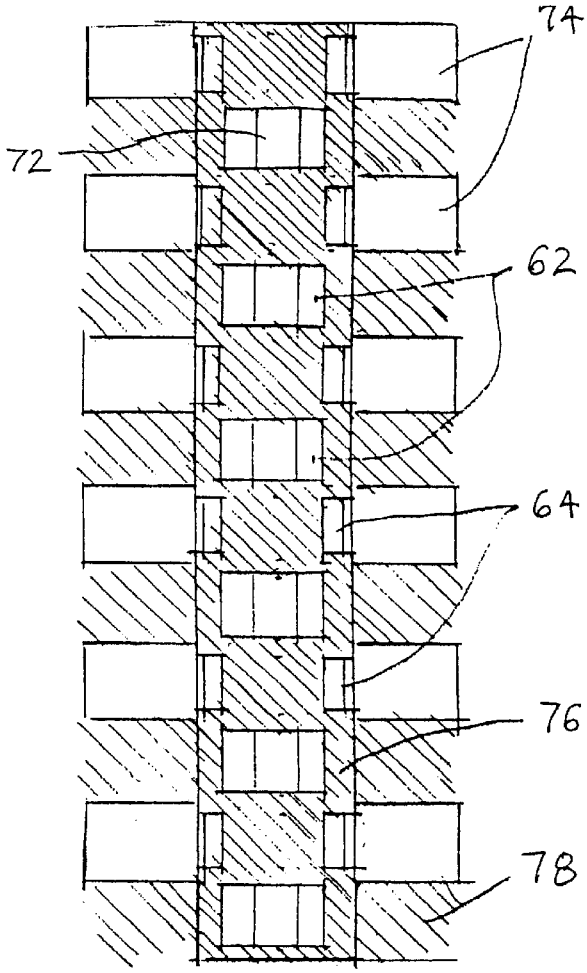
FIG. 15 is a plan view of the lighting arrangement of FIG. 14.

FIG. 14 is an isometric view representing a unified reflector structure 63 partially surrounding a light source 10. Unified reflector structure 63 is a composite of a tubular reflecting section 65 (having open areas 62 on the front of the tube and open areas 64 on the side of the tube) and a rear reflecting surface comprising alternate specular sections 66 with open areas 68 between them. Light from light source 10 traveling through open areas 62 as rays 67 appear as bright areas 72 (FIG. 15). Light from light source 10 travelling through open areas 64 as rays 70 are reflected by reflector sections 66 to provide reflected rays 69 which appear as bright areas 74 (FIG. 15).

FIG. 15 is a plan view of FIG. 1 illustrating a contrasting pattern of light areas 72 and 74 and dark areas 76 and 78.

Although both FIG. 14 and FIG. 15 illustrate a pattern of rectangular reflective and refractive areas, the open or reflective areas may be of any geometric or organic shape. The structure of FIG. 14 may be covered by a refracting jacket such as jacket 12 of FIG. 1.

Figure 4:
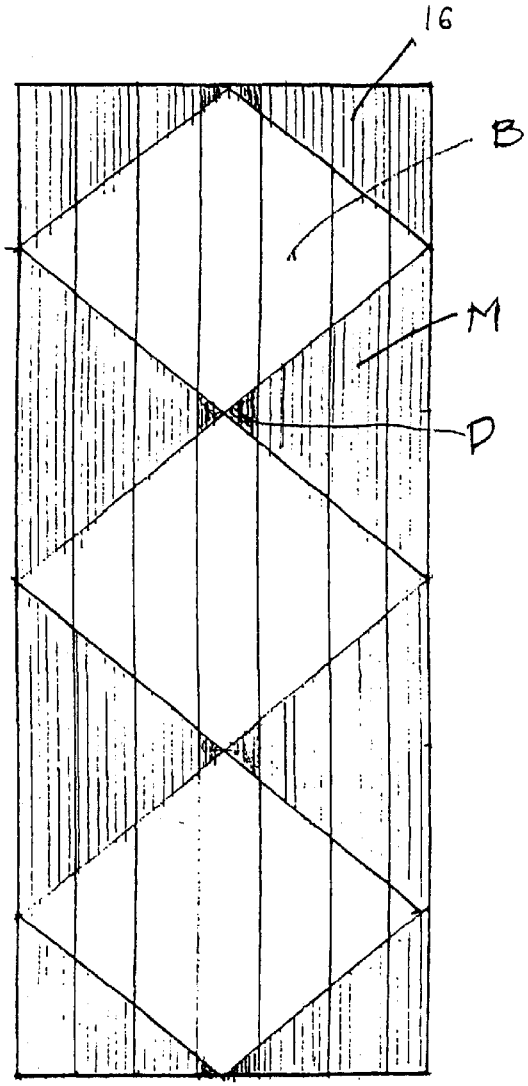
FIG. 4 is a diagrammatic view of the light pattern formed by the lighting arrangement of FIG. 3.
Figure 16:
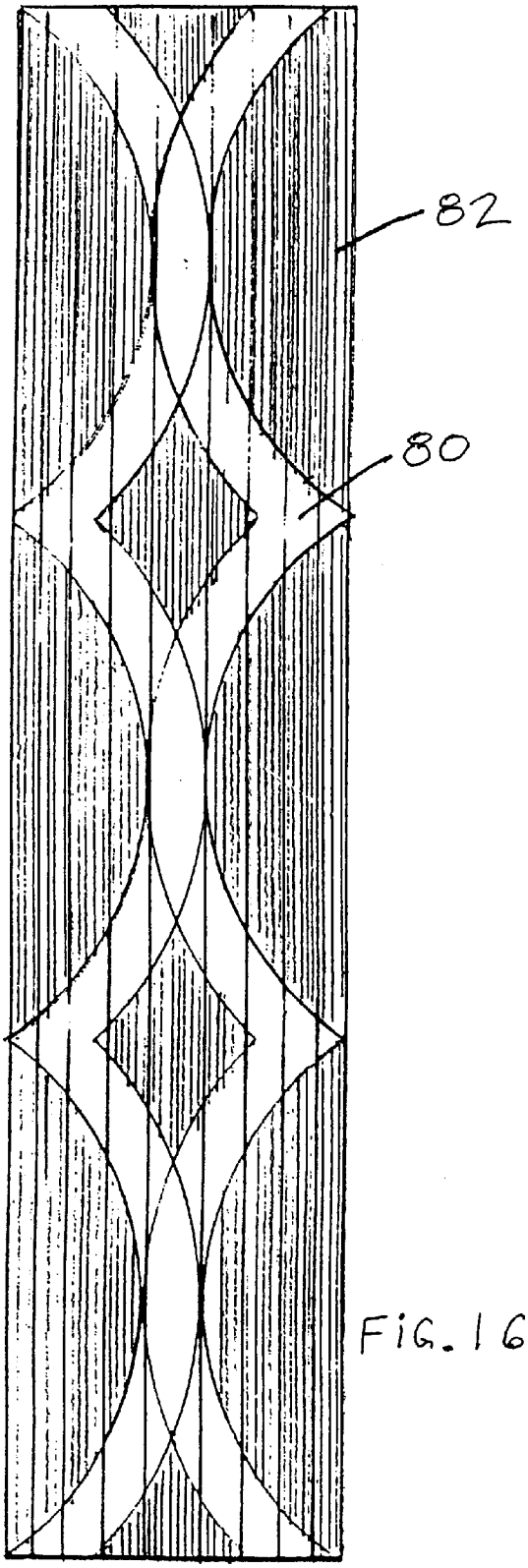
FIG. 16 is a diagrammatic view showing a lighting pattern of the present invention.
Figure 17:
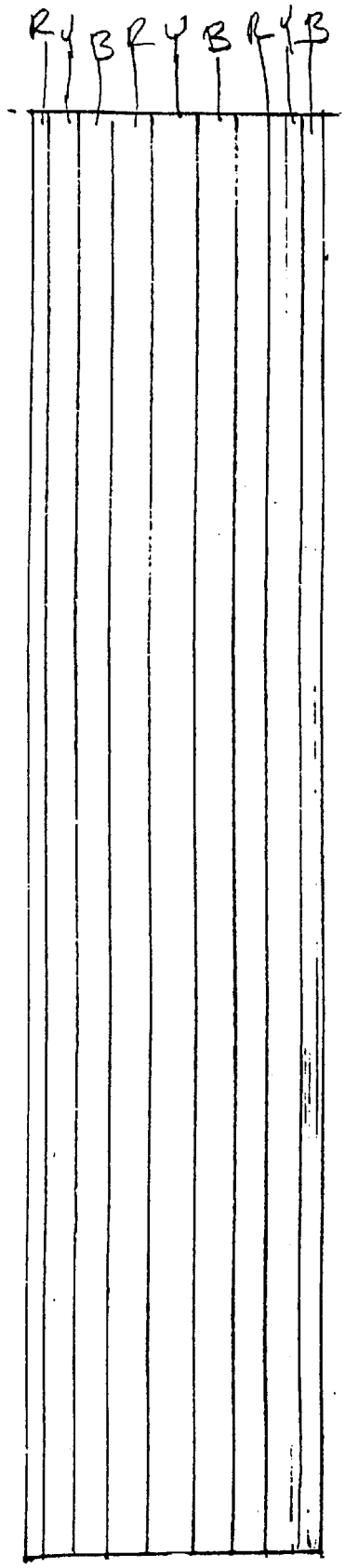
FIG. 17 is a diagrammatic view showing another lighting pattern of the present invention.

FIG. 16 and FIG. 17 illustrate alternate patterns to that of FIG. 4. FIG. 16 shows bright area 80 in contrast to dark areas 82. FIG. 17 illustrates a pattern of colored illuminated stripes as R, Y, and B for red, yellow and blue. Bright areas projecting colored light can be achieved by the coloring the reflective areas or using color filters in open or refractive areas.

Figures 18, 19A, 19B, 19C:
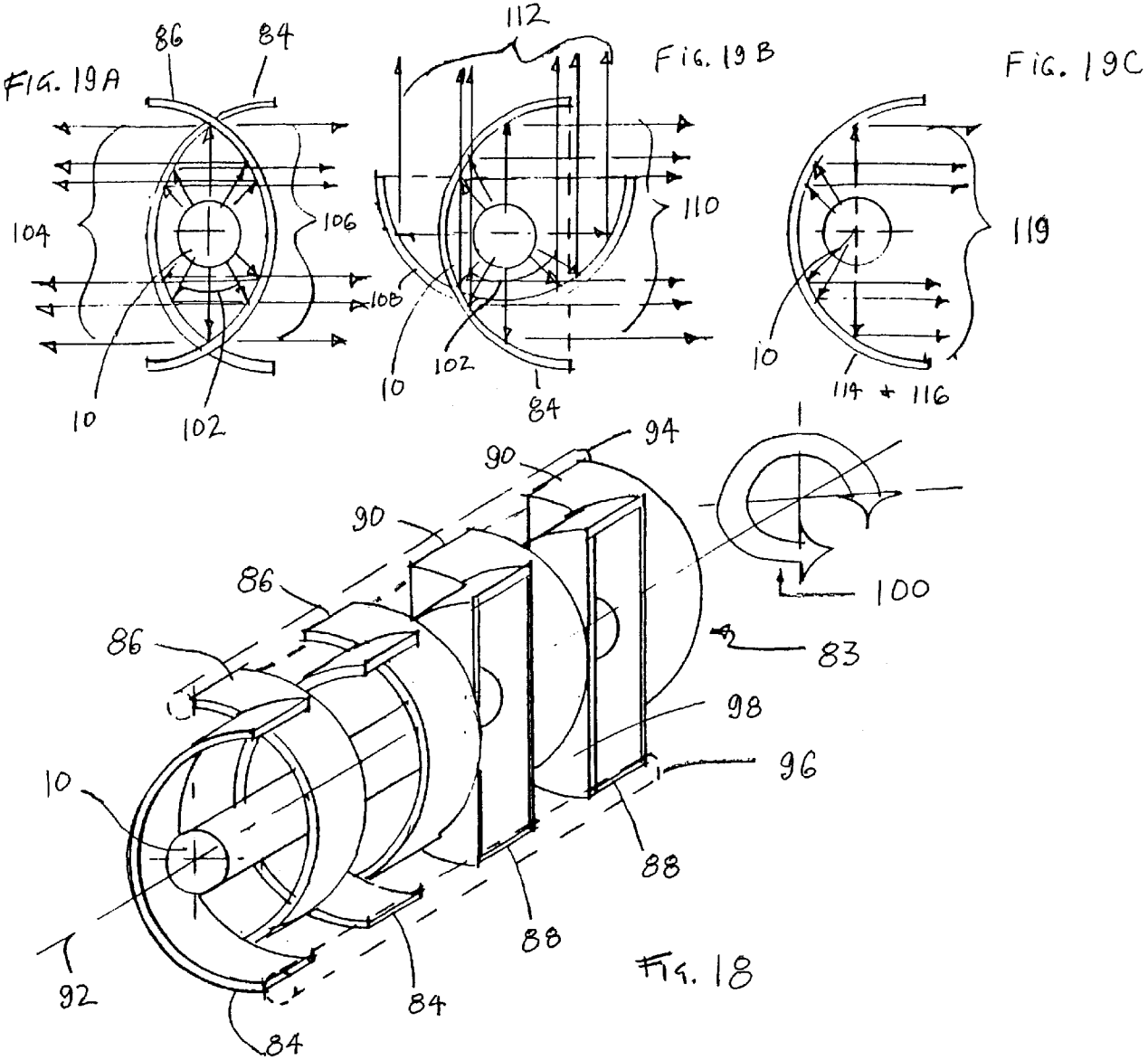
FIG. 18 is an isometric view of a lighting arrangement which includes a series of reflectors partially surrounding a light source.
FIG. 19A is a side view of the structure shown in FIG. 18.
FIG. 19B is a side view of the structure shown in FIG. 18.
FIG. 19C is a side view of the structure shown in FIG. 18.

FIG. 18 is an isometric view of a lighting arrangement 83 which includes a series of reflectors partially surrounding a linear light source 10. Open reflectors facing right 84 alternate with open reflectors facing left 86; closed reflectors facing right 88 alternate with closed reflectors facing left 90. All reflectors 86 and 90 can rotate 360 degrees about light source axis 92 either individually or in groups or in staggered groups by attaching alternate reflectors mechanically. One manner of accomplishing this is to provide a bar 94 to which is attached reflectors 86 and 90, and bar 96 to which is attached reflectors 84 and 88. Closed reflectors 88 and 90 are constructed with specular sides 98.

FIGS. 19A, 19B and 19C represent a side view of FIG. 18. Each figure has two reflectors shown in varied positions to each other. By rotating at least one reflector about light source axis 92 (as shown as rotational arrow 100 in FIG. 18) the rays 102 emanating from light source 10 that are collected by the rotated reflector may be directed away from light source axis 92 at any radial degree that is perpendicular to the light source axis 92.

FIG. 19A illustrates two reflectors, 86 an 84, collecting and directing rays 102 as rays 104 and 106 at 180 degrees away from each other.

FIG. 19B illustrates two reflectors 84 and 108 projecting rays 110 and 112 (respectively ) at 90 degrees away from each other.

FIG. 19C illustrates two reflectors 114 and 116 facing the same direction, projecting rays 119 in the same direction.

FIGS. 20, 21, 22, 23 and 24 illustrate a linear light source lighting system and various components thereof.

Figures 20, 21, 22, 23, 24:
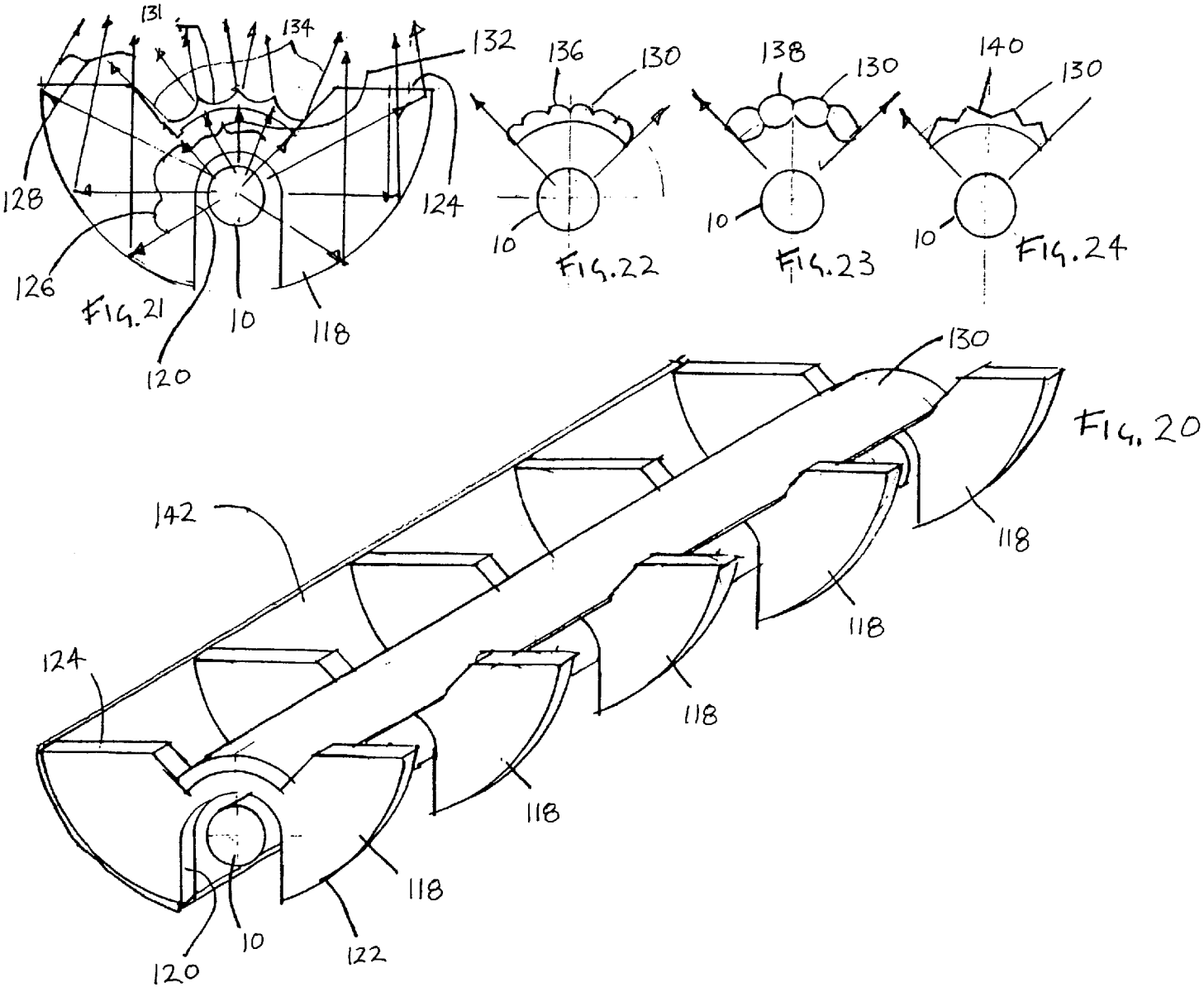
FIG. 20 is an isometric view of a lighting system using various reflecting and refracting components.
FIG. 21 is a diagrammatic view of a section through the system of FIG. 20 having a fluted linear refracting surface.
FIG. 22 is a diagrammatic view showing another type of linear refracting surface.
FIG. 23 is a diagrammatic view showing a further type of linear refracting surface.
FIG. 24 is a diagrammatic view showing still another type of linear refracting surface.

FIG. 20 is an isometric view of a lighting system of various components. The primary component that may be used with light source 10 without the requirement of other components is reflecting transmission guide 118. The reflecting transmission guides 118 are made of a solid transparent material such as plastic or glass. Guides 118 have an entry surface 120 which fully or partially surrounds the light source 10, a reflective surface 122 which may be circular, parabolic or ellipsoidal (which reflects by the principle of total internal reflection or by being vacuum deposited with a reflective material to enhance efficiency) and an exit surface 124 for rays to leave. The function of the guides 118 is shown in FIG. 21. Rays 126 emanating from light source 10 enter entry surface 120, pass through its transparent composition to reflecting surface 122 (which may be circular, parabolic, or ellipsoidal) and are reflected through exit surface 124 as rays 128.

A linear refractive element 130 partially surrounds light source 10 that can be used with elements 118 as a physical bridge to connect elements 118 and to refract light not collected by 118 for purposes of diffusing or redirecting rays from 10.

FIG. 21 demonstrates the refracting function of one type of cross-section of linear refractive element 130. Rays 132 emanating from light source 10 are refracted as rays 134 by the negative cylindrical fluting 131 of linear refracting element 130. Other cross-sectional configurations of refracting element 130 include (but are not restricted to) those shown in FIG. 22 as a positive fluted surface 136, in FIG. 23 as a double fluted surface 138, and in FIG. 24 as the surface 140 comprised of V grooves.

FIG. 20 shows a bridge member 142 having a reflective surface which (partially surrounding 10) can also be used with components 118 as a physical bridge connecting the guides 118 and to collect and project the light not collected by components 118.

The surface of bridge member 142 may be specular or white and may be ribbed in a positive or negative pattern.

Bridge member 142 may or may not follow the contour of 122 and may be circular, parabolic or elliptical.

FIGS. 25 and 26 are projected views of light source 10 and a reflector 144 (that can rotate 360 degrees about light source 10, graphically illustrated by arrow 146) shown in two positions 148 and 150. As reflector 144 rotates about light source 10, rays projected away from reflector 144 change direction in relation to reflector 144 as comparatively illustrated in the direction rays 152 in FIG. 25 to rays 154 in FIG. 26.

FIGS. 27, 28 and 29 illustrate light source 10, rotating reflector 156 (in positions 158, 160 and 162), and a secondary reflector 164 which is fixed in its position to light source 10. As reflector 156 is made to rotate about light source 10, light emanating from light source 10 is gathered by reflector 156 and projected in a direction away from reflector 156. FIG. 27 illustrates reflector 156 in position 158 facing secondary reflector 164, with rays 166 projected toward reflector 164 and being reflected away from reflector 164 as rays 168.

FIG. 28 shows reflector 156 in position 160 projecting rays 172 away from reflector 164 at approximately 90 degrees. FIG. 29 shows reflector 156 in position 162 projecting all rays away from reflector 164 as rays 174. In addition to the function of reflector 156 projecting light in various directions in relationship to reflector 164, the radial position of reflector 156 controls the amount of light (emanating from 10, not gathered by reflector 156) that strikes and is therefore reflected by reflector 164. In FIG. 27 all the light emanating from light source 10 is located in the focal point (or in the optimal optical position) of reflector 156 and reflector 164. In FIG. 27, light not gathered by reflector 156 is gathered and reflected by reflector 164 as reflected rays 168. In FIG. 28, a portion of the light not gathered by reflector 156 strikes the right side of reflector 164 and is reflected as rays 168. In FIG. 29, reflector 156 blocks all the light not gathered from reflector 164.

Reflectors 156 and 164 may have ellipsoidal, parabolic, circular, or other geometric cross sections and may be specular in varying degrees and/or may have negative or positive flutes, bumps or indentations.

FIG. 30 shows a configuration of four light sources 10 partially surrounded by reflectors 178, two of which are in position 180 and two are in position 182. Reflectors 178 in position 180 collect light emanating from light source 10 and project light towards reflector surface 184, which then projects light away from surface 184 as rays 186. When reflectors 178 are in position 182, light emanating from light source 10 collected by reflector 178 is projected away from surface 184 as rays 186. Each reflector can rotate 360 degrees about light source 10 and therefore position light away from the source at any angle toward the reflector 184 as indirect illumination or away from reflector 184 as direct illumination. Reflector 184 may be specular, semi-specular, or white. Reflector 184 may be a component of a luminaire or an architectural surface such as a wall or ceiling.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A light assembly comprising:

a. a linear light source;

b. a main linear element surrounding said light source and including a refracting portion; said linear element further including thereon a pattern of reflecting portions and spaces where there are no reflecting portions; and said pattern extending along the length of said light source and parallel thereto so that light rays reflected from said reflecting portions and light rays emanating from the light source toward the refracting portion provide bright and dim patterns of light which are visible to a viewer through the refracting portion.

2. A light assembly as defined in claim 1 further comprising a central refractor located between said light source and said refracting portion.

3. A light assembly as defined in claim 2 wherein portions of said central refractor have reflective coatings.

4. A light assembly as defined in claim 3 wherein said reflecting portions, said coatings, said refracting portion and said spaces are arranged to provide a pattern of light areas and dark areas when light is emanating from the light source.

5. A light assembly as defined in claim 2 wherein the surfaces of said refracting portion and said refractor have negative flutes or positive flutes or V grooves to modify light patterns by altering the direction of rays entering or leaving the refracting portion and the central refractor.

6. A light assembly as defined in claim 2 wherein said refracting portion is arcuate, or angled, or rectangular, and has flutes, said central refractor is semi-circular, angular, or of multiple curve sections.

7. A light assembly as defined in claim 1 wherein said spaces are disposed between said reflecting portions to form a decorative pattern.

8. A light assembly comprising:

a. a linear light source;

b. a main refractor extending along the length of said light source and parallel thereto, said main refractor surrounding said light source thereby to provide a front portion, c. said main refractor having a rear portion coated with a reflecting material in a desired pattern extending along the length of said main refractor, said front portion of said main refractor also being coated with a reflecting material in a desired pattern extending along the length of said main refractor.

9. A light assembly as defined in claim 8 further comprising a central refractor located between said light source and said front portion of said main refractor.

10. A light assembly as defined in claim 9 wherein portions of said central refractor have reflective coatings.

11. A light assembly as defined in claim 10 wherein at least one coating is arranged to provide a pattern of light areas when light is reflected from the coating.

12. A light assembly as defined in claim 10 wherein said reflective coating is of varied colors.

13. A light assembly as defined in claim 9 wherein at least one of the surfaces of at least one of said main and central refractors has at least one chosen from the group comprising negative flutes, positive flutes and V grooves to modify light patterns by altering the direction of rays entering or leaving the refracting surfaces.

14. A light assembly as defined in claim 9 wherein at least one said central refractor and said main refractor has varied colors.

15. A light assembly comprising:

a. a linear light source;

b. a main refractor extending along the length of said light source and parallel thereto, said main refractor having a rear portion coated with a reflecting material in a desired pattern extending along the length of said main refractor, said rear portion of said main refractor being chosen from the group comprising fluted, angled, and rectangular, a central refractor disposed between the rear portion of said main refractor and a front portion of said main refractor, said central refractor being chosen from the group comprising semi-circular, angular, and of multiple curve sections, and the front portion of said main refractor being chosen from the group comprising fluted, angled and rectangular.

16. A light assembly as defined in claim 15 wherein said central refractor has connecting elements for connecting the central refractor to a choice from the group comprising (1) the rear portion of said main refractor and (2) the front portion of said main refractor.

17. A light assembly comprising:

a. a linear light source;

b. a main linear element surrounding said light source and including a first refracting portion and a second refracting portion and a pattern having reflecting portions and spaces where there are no reflecting portions extending along the length of said light source and parallel thereto;

whereby some of the light rays from the light source pass through the first refracting portion and second refracting portion while other of the light rays emanating from the light source are reflected by the reflecting portions toward and through the second refracting portion providing a resulting visual effect of the combined elements of a pattern of bright shapes at the reflecting portions and dim shapes at the spaces.

18. A light assembly as defined in claim 17 wherein said refracting portions surrounds said light source.

19. A light assembly as defined in claim 17 wherein said refracting portions includes prisms or lenses which alter the visual quality of the reflecting portions.

* * * * *